US005744734A

United States Patent [19]

Yang et al.

[11] Patent Number: 5,744,734

[45] Date of Patent: Apr. 28, 1998

[54] FABRICATION PROCESS FOR HIGH TEMPERATURE ALUMINUM ALLOYS BY SQUEEZE CASTING

[75] Inventors: Chih-Chao Yang; Edward Chang, both of Tainan, Taiwan

[73] Assignee: Industrial Technology Research Institute, Hsinchu, Taiwan

[21] Appl. No.: 551,110

[22] Filed: Oct. 31, 1995

[51] Int. Cl.[6] ..... B22F 9/08; C22C 21/00

[52] U.S. Cl. ..... 75/249; 428/547; 148/512; 148/514; 148/549; 148/437; 419/5; 419/27; 419/46; 419/47

[58] Field of Search ..... 75/249; 419/5, 419/27, 46, 47; 148/512, 514, 549, 437; 428/547

[56] References Cited

U.S. PATENT DOCUMENTS

| | | | |
|---|---|---|---|
| 4,597,792 | 7/1986 | Webster | 75/249 |
| 4,693,747 | 9/1987 | Bretz et al. | 75/249 |
| 4,715,893 | 12/1987 | Skinner et al. | 75/249 |
| 4,729,790 | 3/1988 | Skinner | 75/249 |
| 4,828,632 | 5/1989 | Adam et al. | 148/437 |
| 5,292,358 | 3/1994 | Miura et al. | 75/249 |

*Primary Examiner*—Ngoclan Mai
*Attorney, Agent, or Firm*—W. Wayne Liauh

[57] ABSTRACT

A method for fabricating articles of high-temperature aluminum alloys having a compressional strength of at least 20 kg/mm$^2$ at temperatures of 300° C. or greater, is disclosed. The method comprises the steps of: (a) forming a porous preform from particles of a first aluminum alloy via cold-pressing, the preform having the shape and dimension of the aluminum alloy article to be fabricated; (b) squeeze-casting a molten second aluminum alloy into void spaces of the porous preform to form an aluminum composite containing the first aluminum alloy, which serves as a reinforcement phase, dispersed in the second aluminum alloy, which serves as a matrix phase; (c) wherein the molten second aluminum alloy is cast at such temperatures so as to cause a surface of the first aluminum alloy particles to melt and thereby form a strong bonding with the second aluminum alloy. The first aluminum alloy particles are formed by melt-spinning, followed by rapid solidification and precipitation, of a composition of the first aluminum alloy to form a thin ribbon, then pulverizing the thin ribbon into particles. Unlike the prior art processes, which fabricate high-temperature aluminum alloys only in essentially two-dimensional articles, the method disclosed herein allows the capability of near net shaping, i.e., it can fabricate high-temperature aluminum alloy articles of essentially any intended shapes. The present process allows selective reinforcement of the fabricated articles to be achieved at strategically important locations, so as to expand the range of engineering applications of the fabricated articles without incurring substantially increased manufacturing cost.

20 Claims, 2 Drawing Sheets

FABRICATION PROCESS FOR HIGH TEMPERATURE ALUMINUM ALLOYS BY SQUEEZE CASTING

FIELD OF THE INVENTION

The present invention relates to a process for fabricating high-temperature aluminum alloys. More specifically, the present invention relates to a improved process for fabricating three-dimensional articles from high-temperature aluminum alloys by squeeze casting. The high-temperature aluminum alloys fabricated from the process disclosed in the present invention exhibit a compressional strength greater than 20 kg/mm$^2$ at temperatures of 300° C. or greater.

BACKGROUND OF THE INVENTION

A number of methods for obtaining high-temperature high-strength (mainly high compressional strength) aluminum-based alloys have been disclosed in many prior art references, including U.S. Pat. Nos. 2,963,780, 2,967,351, and 3,462,248, the contents thereof are incorporated herein by reference. In the methods disclosed in these patents, the high-temperature aluminum alloys are produced by atomizing liquid metals into finely divided droplets using high velocity gas streams. The droplets are cooled by convective cooling at a very rapid rate of approximately $10^{4}$° C./sec. By this rapid cooling, aluminum alloys containing greater amounts of transitional metals are produced, resulting in higher strength at elevated temperatures.

U.S. Pat. No. 4,729,790, the content thereof is incorporated herein by reference, discloses an aluminum-based alloy formed by the rapid solidification method which consists of $Al_{bal}Fe_aSi_bX_c$, wherein X is at least one element selected from the group consisting of Mn, V, Cr, Mo, W, Nb, and Ta, "a" ranges from 1.5 to 7.5 atom percent, "b" ranges from 0.75 to 9.0 atom percent, "c" ranges from 0.25 to 4.5 atom percent, and the balance is aluminum plus incidental impurities, with the proviso that the ratio [Fe+X]: Si ranges from about 2.01: 1 to 1.0 to 1. The alloys disclosed in the '790 patent exhibited high strength and high ductility. U.S. Pat. No. 4,828,632, the content thereof is incorporated herein by reference, discloses a specific embodiment of the aluminum-based alloys disclosed in the '790 which consists of $Al_{bal}Fe_aSi_bV_c$, wherein "a" ranges from 3.0 to 7.1 atom percent, "b" ranges from 1.0 to 3.0 atom percent, "c" ranges from 0.25 to 1.25 atom percent, and the balance is aluminum plus incidental impurities, with the proviso that (I) the ratio [Fe+V]: Si ranges from about 2.33: 1 to 3.33 to 1 and (ii) the ratio Fe:V ranges from 11.5:1 to 5:1. U.S. Pat. No. 4,715,893, the content thereof is incorporated herein by reference, discloses another similar aluminum-based alloy consisting of $Al_{bal}Fe_aV_bX_c$, wherein X is at least one element selected from the group consisting of Zn, Co, Ni, Cr, Mo, Zr, Ti, Hf, Y and Ce, "a" ranges from about 7–15 wt %, "b" ranges from about 2–10 wt %, "c" ranges from 0–5 wt %, and the balance is aluminum.

Typically articles of the high-temperature aluminum alloys are formed by first forcing the molten metal of the desired composition under pressure through a slotted nozzle and onto the surface of a chill body, to thereby form a very thin (typically less than 40 micrometers thick) cast strip, or the so-called "ribbon", of metal. The requirement for such a rapid quenching rate necessitates the formation of an essentially two-dimensional aluminum alloy in the form of a thin ribbon (so that the thickness of the article will not hinder heat transfer). The rapidly solidified aluminum alloy ribbons are then processed into particles of about 60 to 200 mesh in size by conventional comminution devices such as pulverizers, knife mills, rotation hammer mills, and the like. Thereafter, the particles are placed in a vacuum evacuated can (under a vacuum of typically less than $10^{-4}$ torr) and compacted by conventional powder metallurgy techniques such as hot pressing to form aluminum alloy billet. The aluminum billet is then extruded or forged under high pressure to form aluminum articles.

Another conventional method to form high-temperature aluminum alloy articles is to atomize the aluminum alloy of the desired composition and form aluminum alloy powders. The aluminum alloy powders are then similarly placed in a vacuum-evacuated can and compacted by conventional powder metallurgy techniques such as a hot pressing process to form aluminum alloy billets. The aluminum billets are then extruded or forged to form the desired aluminum articles. The second method is very similar to the first method, except that it involves a different procedure for rapid cooling, i.e., via atomization. Both methods suffer from a major drawback in that they require a prolonged and relatively complicated operation, which requires high manpower and incurs high manufacturing cost. Another major drawback of the conventional methods in making high-temperature aluminum alloys is that the hot pressing process only produces essentially two-dimensional bar-shaped or block aluminum articles, it cannot produce three-dimensional articles of near net shaping. Because of these limitations, it is, therefore, highly desirable to develop an improved method which will enable three-dimensional articles of various shapes and designs to be fabricated from high-temperature high-strength aluminum alloys which provide precise near net shaping. It is also desirable to develop an improved method that will simplify the procedure and reduce the cost for fabricating high-temperature high-strength aluminum alloys.

SUMMARY OF THE INVENTION

The primary object of the present invention is to develop an improved process for fabricating high-temperature aluminum alloys by squeeze casting. More specifically, the primary object of the present invention is to develop an improved process for fabricating high-temperature aluminum alloys, which exhibit a compressional strength greater than 20 Kg/mm$^2$ at temperatures above about 300° C., preferably above about 400° C., and can be formed into a variety of shapes and designs. The process disclosed in the present invention also provides the advantages that (1) it provides the capability of allowing near-net-shaping (i.e., matching the designed shape) of the fabricated high-temperature aluminum articles to be obtained; and (2) it allows selective reinforcement of the fabricated articles to be achieved at strategical locations, so as to expand the range of engineering applications of the fabricated articles without incurring substantially increased manufacturing cost.

In the method disclosed in the present invention, high-temperature aluminum alloy materials, such as Al—Fe—Si, Al—Fe—Zr, Al—Fe—Ce, Al—Fe—Mo—V, Al—Fe—V—Si, etc. aluminum alloy series compositions, are subject to melt spinning and atomization to form an intermetallic dispersoid and supersaturated solid solution, which exhibits excellent stability at elevated temperatures. Because of the extremely low diffusion rate at the dispersoid phase, no aggregation (i.e., grain growth) is observed, and the very fine (50 nm to 100 nm) precipitates are formed. These precipitates also occupy a relatively high volume percentage (12–25%, by volume). As a result, the dislocations are locked into their respective positions with high resistance to dislocation movement. This allows the aluminum alloys to exhibit high strength even at elevated temperatures.

After melt spinning and atomization, the aluminum alloy is formed into a thin ribbon 16–35 mm wide and 50–70 μm thick. Then the aluminum alloy is pulverized using a pulverizer, ball miller, or knife to form 20–300 μm particles. The aluminum alloy particles of varying sizes are cold-pressed into a porous "preform" having a volume faction of 50–80%. Unlike the prior art processes, which can fabricate high-temperature aluminum alloys in essentially two-dimensional articles, the aluminum alloy preform of the present invention can be fabricated into any desired shape, imitating the shape of the final article to be fabricated. The volume fraction and metal composition of the preform can also be tailored to suit the need of the final product. For example, some portion or portions of the preform may be further reinforced, by using a higher volume fraction of solid content and/or further reinforced metal composition, in accordance with the functional need of the final product.

After the preform is formed, it is placed into a fixed position in a mold. Then molten liquids of high-strength and highly corrosion- and abrasion-resistant aluminum alloys such as A201, A315, A356, etc., are forced to penetrate into the pore spaces of the porous preform. This liquid molten aluminum alloy is termed the "second aluminum alloy", as opposed to the "first aluminum alloy" which constitutes the preform. Other aluminum alloys may also be used as the second aluminum alloy, including the cast aluminum alloys such as the 100, 200, 300, 400, 500, and 700 series, and wrought aluminum alloys such as the 1000, 2000, 3000, 4000, 5000, 6000 and 7000 series. Upon contacting with the molten second aluminum alloy, the first aluminum alloy will partially melt at the surface thereof, thus forming a strong bonding with the second aluminum alloy. After high-pressure solidification, an aluminum composite will form which contains the second aluminum alloy as the matrix phase (i.e., the continuous phase) and the first aluminum alloy as the reinforcement phase. The strong bonding between the first and second aluminum alloys allows the composite to retain many of the favorable characteristics of the first aluminum alloys. However, unlike the prior art processes, the present invention allows the high-temperature aluminum alloys to be fabricated into essentially any desired shape. The present invention can be most advantageously used in the fabrication of piston crowns (especially for diesel engines), nozzles, aerospace components, etc. Another advantage of the process disclosed in the present invention is that high-strength, high-temperature aluminum alloy parts can be made with near net shaping and at lowered cost.

BRIEF DESCRIPTION OF THE DRAWING

The present invention will be described in detail with reference to the drawings showing the preferred embodiment of the present invention, wherein.

DETAILED DESCRIPTION OF THE PREFERRED EMBODIMENT

Figure 1:
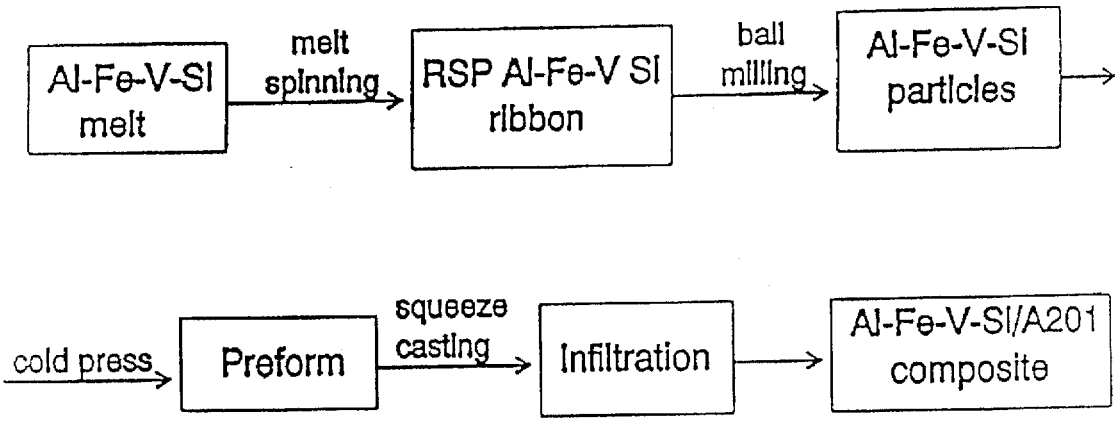
FIG. 1 is a schematic flow chart showing the steps of a preferred embodiment of the process disclosed in the present invention for fabricating high-temperature aluminum alloys.

The present invention discloses an improved process for fabricating high-temperature aluminum alloys by squeeze casting. The high-temperature aluminum alloys fabricated from the process disclosed in the present invention contain a first aluminum alloy as reinforcement phase dispersed in a second aluminum alloy, which serves as the matrix phase. With the process disclosed in the present invention, the high-temperature aluminum alloys can be precision-fabricated into essentially any three-dimensional articles of various shapes and designs, which exhibit a compressional strength greater than 20 kg/mm$^2$ at temperatures above at least 300° C.

In the method disclosed in the present invention, the first aluminum alloys are made from high-temperature aluminum alloy materials, such as Al—Fe—Si, Al—Fe—Zr, Al—Fe—Ce, Al—Fe—Mo—V, Al—Fe—V—Si, etc. aluminum alloy series compositions. Other high-temperature aluminum alloy compositions include the $Al_{bal}Fe_aSi_bX_c$ series disclosed in the '790, '632, and '893 patents may also be used. These high-temperature aluminum alloy materials are first subjected to melt spinning and atomization to form an intermetallic dispersoid or supersaturated solid solution, which exhibits excellent stability at elevated temperatures. As discussed above, because of the extremely low diffusion rate at the dispersoid phase, very fine grains (50 nm to 100 nm) can be formed from precipitation. These precipitated particles also exhibit a relatively high volume fraction (12–25% solid content, by volume). As a result, the dislocations are locked into their respective positions with high resistance to dislocation movement. This allows the first aluminum alloys to exhibit high strength at elevated temperatures.

After melt spinning and atomization, the first aluminum alloy is formed into a thin ribbon about 16–35 mm wide and 50–70 μm thick. The first aluminum alloy ribbon is then pulverized using a pulverizer, a ball miller or knife to form particles that are 20–300 μm in size. The first aluminum alloy particles of varying sizes are cold-pressed into a porous "preform" having a volume faction of 50–80%. In the present invention, the first aluminum alloy preform is fabricated into the shape of the final product. This contrasts with all of the prior art processes, which can fabricate high-temperature aluminum alloys only in essentially two-dimensional articles. The volume fraction and metal composition of the preform can also be tailored to suit the need of the final product. For example, some portion or portions of the preform may be reinforced, by selectively introducing a higher volume fraction or and/or using first aluminum alloy particles of a different metal composition, in accordance with the functional need of the final product.

After the preform is formed, it is placed into a fixed position in a mold for infiltrating therein a molten second aluminum alloy. A wide variety of aluminum alloys can be used as the second aluminum allot,s including cast aluminum alloys such as the 100, 200, 300, 400, 500, and 700 series, and wrought aluminum alloys such as the 1000, 2000, 3000, 4000, 5000, 6000 and 7000 series. Preferably, the second aluminum alloy is provide as a molten liquid containing a high-strength and highly corrosion- and abrasion-resistant aluminum alloy such as A201, A315, A356, etc. The molten second aluminum alloy is introduced by force to penetrate into the pore space of the porous preform formed from the first aluminum alloy. Upon contacting with the molten second aluminum alloy, the first aluminum alloy will partially melt at the surface thereof This causes to be formed a strong bonding between the first and the second aluminum alloys. After high-pressure solidification, an aluminum composite is formed which contains the second aluminum alloy as the substrate or the continuous phase, and the first aluminum alloy as the reinforcement phase. The strong bonding between the first and second aluminum alloys allows the aluminum alloy composite of the present invention to retain many of the favorable characteristics of the first aluminum alloys at elevated temperatures. However, unlike the prior art processes, the present invention allows the high-temperature aluminum alloys to be fabricated into essentially any desired shape. The present invention can be most advantageously used in the fabrication of piston crowns for diesel engines, jet nozzles and other aeronautic components. Again, one of the main advantages of the process disclosed in the present invention is that high-strength, high-temperature aluminum alloy parts can be made with near net shape and at lowered cost.

FIG. 1 is a schematic flow chart showing the steps of a preferred embodiment of the process disclosed in the present invention for fabricating high-temperature aluminum alloys. First, a high-temperature first aluminum alloy (here Al—Fe—V—Si) is melted. The molten first aluminum alloy composition is subjected to melt-spinning, followed by rapid solidification and precipitation (RSP), to form an Al—Fe—V—Si ribbon. The Al—Fe—V—Si ribbon is pulverized via ball milling to form Al—Fe—V—Si particles, which are cold-pressed to form a preform. The preform is placed in a fixed position in a mold, into to which a second aluminum alloy (A201) in molten form is squeeze cast to cause infiltration into the porous space in the preform. After cooling, a Al—Fe—V—Si/A201 composite is formed.

Figure 2:
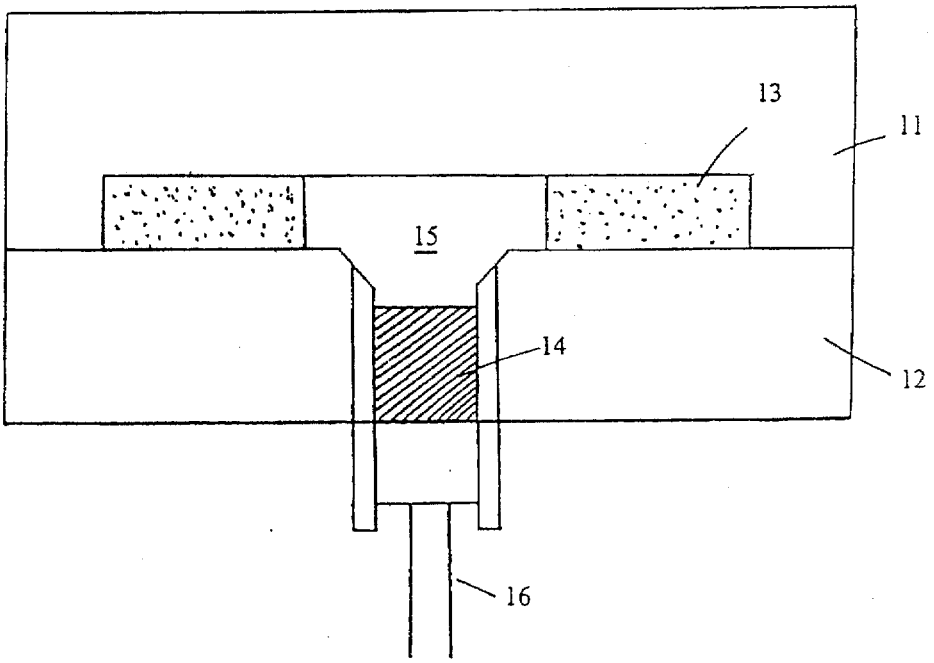
FIG. 2 is a schematic diagram showing the squeeze casting device for fabricating high-temperature aluminum alloys disclosed in the present invention.

FIG. 2 is a schematic diagram showing the squeeze casting device for fabricating the high-temperature aluminum alloys disclosed in the present invention. The preform 13 is first placed inside a die, which comprises an upper die 11 and a lower die 12. After the upper and lower dies are closed, a molten second aluminum alloy 14 is injected into the die cavity 15 via a plunger tip 16 under high pressure. The molten second aluminum alloy 14 is forced by the injection pressure to penetrate into the interstices of the preform and fill the entire pore space to form a matrix phase.

Figure 3:
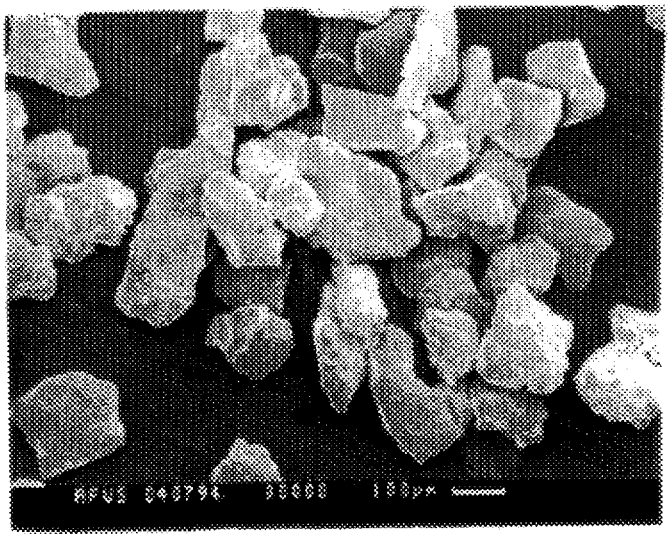
FIG. 3 is an SEM micrograph showing the particles of the first aluminum alloy after rapid solidification.
Figure 4:
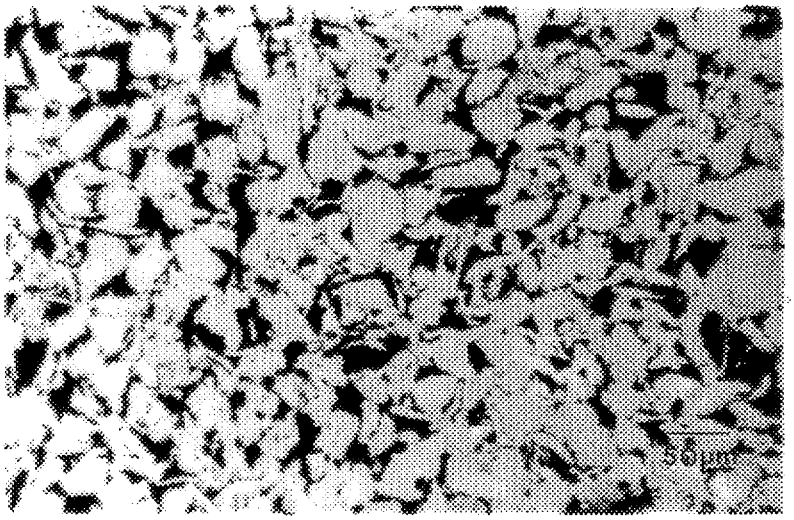
FIG. 4 is an optical micrograph showing the internal pore structure of a preform which contains particles of the first aluminum alloy after rapid solidification and compaction.
Figure 5:
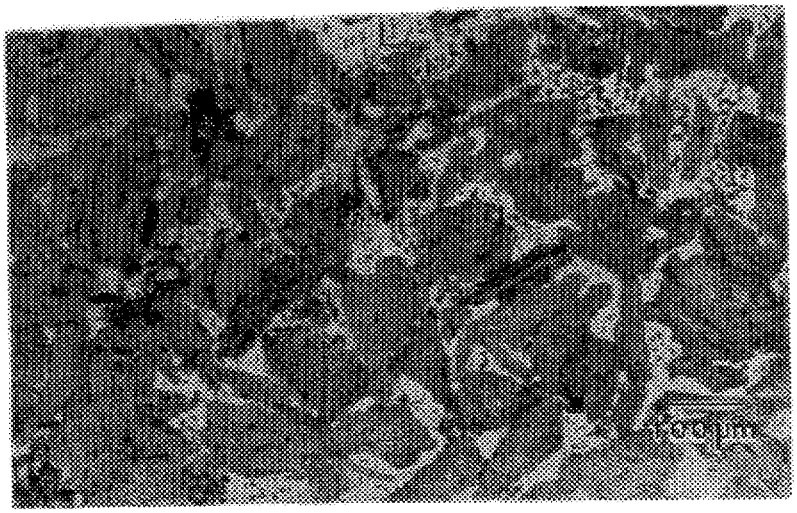
FIG. 5 is an optical micrograph of the composite aluminum formed from the present invention which contains the first aluminum alloy (as the reinforcement phase) dispersed in the second aluminum alloy (as the matrix phase).

FIG. 3 is an SEM micrograph showing the particles of the first aluminun alloy after rapid solidification. The uncompacted first aluminum alloy particles have a dimension of between 20 and 300 μm. FIG. 4 is an optical micrograph showing the internal pore structure of a preform which contains particles of the first aluminum alloy after rapid solidification and compaction. The volume faction of the compacted first aluminum alloy preform is about 50–80%. FIG. 5 is another optical micrograph showing the composite aluminum formed from the present invention which contains the first aluminum alloy (as the reinforcement phase) dispersed in the second aluminum alloy (as the matrix phase).

The present invention will now be described more specifically with reference to the following examples. It is to be noted that the following descriptions of examples, including the preferred embodiment of this invention, are presented herein for purposes of illustration and description, and are not intended to be exhaustive or to limit the invention to the precise form disclosed.

EXAMPLE 1

A first aluminum alloy composition was prepared which contained 11.7 wt % Fe, 1.15 wt % V, 2.4 wt % Si, and the balance being aluminum. This first aluminum alloy composition, which is designated as FVS1212, was heated, by an induction process, to melt under an argon environment. The molten first aluminum alloy composition was subjected to melt spinning, followed by rapid solidification and precipitation to form a ribbon about 50–80 mm in width. The FVS1212 aluminum alloy contained about 37 vol % of thermally stable $Al_{12}(Fe, V)_3Si$ dispersoids, which have an average particle size between about 50–80 nm. The high volume fraction of the $Al_{12}(Fe, V)_3Si$ dispersoids and the existence of the supersaturated aluminum matrix contributed to the property enhancement of the aluminum alloy at elevated temperatures.

The FVS1212 aluminum alloy ribbon was ball milled to 100–300 μm particles, which were cold-pressed under 300 $kg/mm^2$ to form a preform. The preform had a solid content of 65 vol %. The FVS1212 preform was then placed inside a die, and a molten A201 aluminum alloy, which constituted the second aluminum alloy, was forced to penetrate the pore space of the preform using a squeeze casting procedure to consolidate the first aluminum alloy particles. The final product was an FVS1212/A201 aluminum composite containing A201 as the matrix phase and the FVS1212 as the reinforcement phase.

The FVS1212/A201 aluminum composite from Example 1 was tested under a working condition of 300° C., and its compressional strength was measured to be 30 $kg/mm^2$. This is a very significant improvement over the A201 aluminum alloy, which showed a compressional strength of only 15 $kg/mm^2$.

EXAMPLE 2

A first aluminum alloy composition was prepared which contained 7.85 wt % Fe, 1.47 wt % V, 1.52 wt % Si, and the balance being aluminum. This first aluminum alloy composition, which is designated as FVS0811, was heated by induction to melt under an argon environment. The molten first aluminum alloy composition FVS0811 was subjected to melt spinning, followed by rapid solidification and precipitation to form a ribbon about 40–60 mm in width. The first aluminum alloy ribbon was ball milled to 100–300 μm particles, which were cold-pressed under 300 $kg/mm^2$ to form a preform. The preform had a solid content of 80 vol %. The FVS0811 preform was then placed inside a die, and a molten A356 aluminum alloy, which constituted the second aluminum alloy, was forced to penetrate the pore space of the preform using a squeeze casting procedure to consolidate the FVS0811 first aluminum alloy particles. The final product was an FVS0811/A356 aluminum composite containing A356 as the matrix phase and the FVS0811 as the reinforcement phase.

The FVS0811/A356 aluminum composite from Example 2 was tested under a working temperature of 300° C., and its compressional strength was measured to be 25 $kg/mm^2$. This is again a very significant improvement over the A356 aluminum alloy, which showed a compressional strength of only 10 $kg/mm^2$.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A method for fabricating articles of high-temperature aluminum alloys having a predetermined shape and dimension, said method comprising the steps of:

(a) forming a porous preform from particles of a first aluminum alloy, said preform having the shape and dimension of an aluminum alloy article to be fabricated;

(b) squeeze-casting a molten second aluminum alloy into void spaces of said porous preform to form an aluminum composite containing said first aluminum alloy, which exists as a reinforcement phase, dispersed in said second aluminum alloy, which exists as a matrix phase, (c) wherein said molten second aluminum alloy is cast at such temperatures so as to cause a surface of said first aluminum alloy particles to melt and thereby form a strong bonding with said second aluminum alloy after cooling.

2. A method for fabricating articles of high-temperature aluminum alloys according to claim 1 wherein said particles of first aluminum alloy are formed by the steps of:

(a) melt-spinning, followed by rapid solidification and precipitation, of a composition of said first aluminum alloy to form a thin ribbon; and (b) pulverizing said thin ribbon into said particles.

3. A method for fabricating articles of high-temperature aluminum alloys according to claim 1 wherein said particles of first aluminum alloy have an average particle size between about 20 and 300 μm.

4. A method for fabricating articles of high-temperature aluminum alloys according to claim 1 wherein said first aluminum alloy is a high-temperature aluminum alloy having a compressional strength of at least 20 kg/mm$^2$ at temperatures of 300° C. or greater.

5. A method for fabricating articles of high-temperature aluminum alloys according to claim 4 wherein said first aluminum alloy is an Al—Fe—V—Si, Al—Fe—Si, Al—Fe—Ce, or Al—Fe—Mo—V, series aluminum alloy.

6. A method for fabricating articles of high-temperature aluminum alloys according to claim 1 wherein said porous preform is formed by cold-pressing said particles of first aluminum alloy under pressure.

7. A method for fabricating articles of high-temperature aluminum alloys according to claim 1 wherein said porous preform has a solid content of about 50 to 80 volume percent.

8. A method for fabricating articles of high-temperature aluminum alloys according to claim 1 wherein said second aluminum alloy is a cast aluminum alloy or a wrought aluminum alloy.

9. A method for fabricating articles of high-temperature aluminum alloys according to claim 1 wherein said second aluminum alloy is a cast aluminum alloy selected from the group consisting of series 100, 200, 300, 400, 500, and 700 aluminum alloys.

10. A method for fabricating articles of high-temperature aluminum alloys according to claim 1 wherein said second aluminum alloy is a wrought aluminum alloy selected from the group consisting of series 1000, 2000, 3000, 4000, 5000, 6000, and 7000 aluminum alloys.

11. An article of high-temperature aluminum alloy having a predetermined shape and dimension and a compressional strength of at least 20 kg/mm$^2$ at temperatures of 300° C. or greater, said article of high-temperature aluminum alloy being fabricated from a process comprising the steps of:

(a) forming a porous preform from particles of a first aluminum alloy, said preform having the shape and dimension of said aluminum alloy article being fabricated;

(b) squeeze-casting a molten second aluminum alloy into void spaces of said porous preform to form an aluminum composite containing said first aluminum alloy, which provides as a reinforcement phase, dispersed in said second aluminum alloy, which provides as a matrix phase;

(c) wherein said molten second aluminum alloy is cast at such temperatures so as to cause a surface of said first aluminum alloy particles to melt and thereby form a strong bonding with said second aluminum alloy after cooling.

12. An article of high-temperature aluminum alloy according to claim 11 wherein said particles of first aluminum alloy are formed by the steps of:

(a) melt-spinning, followed by rapid solidification and precipitation, of a composition of said first aluminum alloy to form a thin ribbon; and (b) pulverizing said thin ribbon into said particles.

13. An article of high-temperature aluminum alloy according to claim 11 wherein said particles of first aluminum alloy have an average particle size between about 20 and 300 μm.

14. An article of high-temperature aluminum alloy according to claim 11 wherein said first aluminum alloy is a high-temperature aluminum alloy having a compressional strength of at least 20 kg/mm$^2$ at temperatures of 300° C. or greater.

15. An article of high-temperature aluminum alloy according to claim 11 wherein said first aluminum alloy is an Al—Fe—V—Si, Al—Fe—Si, Al—Fe—Ce, or Al—Fe—Mo—V, series aluminum alloy.

16. An article of high-temperature aluminum alloy according to claim 11 wherein said porous preform is formed by cold-pressing said particles of first aluminum alloy under pressure.

17. An article of high-temperature aluminum alloy according to claim 11 wherein said porous preform has a solid content of about 50 to 80 volume percent.

18. An article of high-temperature aluminum alloy according to claim 11 wherein said second aluminum alloy is a cast aluminum alloy or a wrought aluminum alloy.

19. An article of high-temperature aluminum alloy according to claim 11 wherein said second aluminum alloy is a cast aluminum alloy selected from the group consisting of series 100, 200, 300, 400, 500, and 700 aluminum alloys.

20. An article of high-temperature aluminum alloy according to claim 11 wherein said second aluminum alloy is a wrought aluminum alloy selected from the group consisting of series 1000, 2000, 3000, 4000, 5000, 6000, and 7000 aluminum alloys.

* * * * *